US005215434A

United States Patent [19]

Greune et al.

[11] Patent Number: 5,215,434

[45] Date of Patent: Jun. 1, 1993

[54] APPARATUS FOR THE ADJUSTMENT OF STATOR BLADES OF A GAS TURBINE

[75] Inventors: Christian Greune, Fürstenfeldbruck; Helmut Gross, Esterhofen; Georg Zotz, Haimhausen, all of Fed. Rep. of Germany

[73] Assignee: MTU Motoren-und-Turbinen Union München GmbH, Munich, Fed. Rep. of Germany

[21] Appl. No.: 825,919

[22] Filed: Jan. 27, 1992

[30] Foreign Application Priority Data

Jan. 25, 1991 [DE] Fed. Rep. of Germany ..... 4102188

[51] Int. Cl.[5] ..... F04D 29/36

[52] U.S. Cl. ..... 415/150; 415/159; 415/160; 415/156

[58] Field of Search ..... 415/148, 149.2, 150, 415/151, 155, 156, 159, 160, 162

[56] References Cited

U.S. PATENT DOCUMENTS

| | | | |
|---|---|---|---|
| 2,718,349 | 9/1955 | Wilde | 415/149.2 |
| 4,003,675 | 1/1977 | Stevens et al. | 415/160 |
| 4,035,101 | 7/1977 | Glenn | 415/160 |
| 4,130,375 | 12/1978 | Korta | 415/162 |
| 4,139,329 | 3/1979 | Korta | 415/162 |
| 4,363,600 | 12/1982 | Thebert | 415/156 |
| 4,618,311 | 10/1986 | Miura et al. | 415/150 |
| 4,755,104 | 7/1988 | Castro et al. | 415/160 |
| 4,810,165 | 3/1989 | Greune et al. | 415/156 |
| 4,836,746 | 6/1989 | Owsianny et al. | 415/160 |
| 5,035,572 | 7/1991 | Popp | 415/156 |

FOREIGN PATENT DOCUMENTS

| | | | |
|---|---|---|---|
| 59400 | 4/1983 | Japan | 415/162 |

*Primary Examiner*—John T. Kwon
*Attorney, Agent, or Firm*—Ladas & Parry

[57] ABSTRACT

Apparatus for the support and adjustment of stator blades of a gas turbine, in which an adjusting ring is connected to the stator blades by adjustment levers disposed outside the turbine housing. The adjusting ring is supported for rotation in the circumferential direction on a support ring, which has elastic resilience in the radial direction, the support ring being suspended on and centered in a movable manner on radial pins fixed in an outer housing of the turbine. The connection of the adjusting ring and the support ring is achieved by a ball-bearing which is pre-stressed. When the adjusting ring is displaced circumferentially, the stator blades are pivoted around suspension shafts by levers fixed to the shafts and connected to the adjusting ring for universal pivotal movement.

20 Claims, 4 Drawing Sheets

30
24
28
2
6
31
3
23
29
27
4
8
10
1
5
11
9
7
X

APPARATUS FOR THE ADJUSTMENT OF STATOR BLADES OF A GAS TURBINE

FIELD OF THE INVENTION

The invention relates to apparatus for the adjustment of the stator blades of a gas turbine, particularly for the adjustment of the stator blades to compensate for differential thermal heating.

BACKGROUND AND PRIOR ART

In the course of operation of a gas turbine, the adjusting means for adjusting the stator blades of the turbine is subjected to significant loads due to differential thermal effects. As a consequence, the cost of construction and operation of the adjusting means to compensate for these conditions and provide for precise blade adjustment is relatively high.

In order to compensate for differential thermal expansion in the adjusting means, it is known to provide excessive play or high heat elasticity which leads to inaccurate blade adjustment and consequent losses in efficiency in the aero-thermodynamic cycle.

In order to obtain precise adjustment of the stator blades independently of the temperature variations due to various operating conditions, it is disclosed in DE-PS 36 23 001 to connect the support or carrier ring to the turbine housing in a heat insulating manner by several connecting brackets distributed at the periphery of the support ring. The brackets are directly connected to the housing of the turbine by an annular flange and the brackets ar positioned radially above and in the direct vicinity of the turbine housing. The brackets have radial elasticity and elastically support the support ring. The support ring is thus still subjected to considerable thermal effects through the brackets, especially differential heat expansion radially of the housing. The support ring is of U-shape, open at the top, on which the adjusting ring is rotatably supported by rollers in the support ring. The adjusting ring has shoulders which retain the rollers axially and radially to assure precise guidance; however, relatively high friction is developed leading to relatively high adjusting forces. This construction also requires a relatively large radial height for its installation which is often not available, especially in the case of drive turbines.

SUMMARY OF THE INVENTION

An object of the invention is to provide apparatus for adjusting the stator blades of a gas turbine which is substantially free of thermal influences from the turbine housing and makes possible a precise blade adjustment with relatively small adjustment forces, all with a compact construction of the adjusting apparatus.

The above, and other objects, are met, according to the invention, by a construction which comprises a plurality of circumferentially spaced pins secured to an outer housing and projecting radially inwards towards an inner housing which forms the casing of the gas turbine and is radially spaced inwardly of the outer housing, a plurality of bushings being slidably mounted on respective pins for axial travel on the pins in the radial direction; the bushings have an outer curved surface which can be conical or spherical and a support ring is suspended radially inwards on the bushings through the intermediary of correspondingly curved surfaces which are rotatable on the curved surfaces of the bushings; an adjusting ring is disposed between the support ring and the inner turbine housing and the adjusting ring is rollably supported from the support ring by means of a plurality of circumferentially spaced rollers disposed between the support ring and the adjusting ring. The adjustable stator blades are pivotably mounted on the inner turbine housing and are connected to the adjusting ring by lever means such that upon circumferential rotation of the adjusting ring, the stator blades are pivotably adjusted to precise positions.

The invention provides a light-weight blade adjustment apparatus which can be installed in a relatively small radial space and operated with low adjustment forces and little friction since the apparatus is installed between the inner turbine housing and the outer enclosing housing and is not significantly subjected to direct and extreme high temperature influences and thus is not subjected to the differential expansions of the turbine housing. The adjusting ring and the support ring are arranged substantially "free" in the space between the inner turbine housing and the outer housing. The bearing formed by the rollers constitutes a combination of a radial and an axial roller bearing.

With respect to temperature gradients in the space between the housings, the inner turbine housing is variably hot during operation while the outer housing is relatively cool. It is advantageous, therefore, for the support ring to be supported for universal movement on spherical surfaces of balls mounted on the radial pins secured to the outer housing as the support ring is deformable radially and uniformly relative to the respective axes of the pins and relative to the longitudinal axis of the turbine. At least three pins are uniformly distributed over the periphery of the outer housing. The circumferential spacing between the rollers represent so-called "spring spaces", in which the support ring can be inwardly deflected due to its elastic deformability. The radial height of the support ring, i.e. its thickness, defines the elasticity of a pre-stress of the latter, the rollers being stressed at a pre-set force from the pre-stress of the support ring for all temperatures that occur. Namely, when the rollers, preferably in the form of balls, are engaged between the support ring and the adjusting ring, they are engaged or clamped between the rings with a predetermined frictional engagement resulting from the pre-stress of the support ring. In effect, the support ring and adjusting ring serve as outer and inner races for the rollers and preserve a pre-stress for the roller bearing over the entire temperature range of operation of the turbine.

DETAILED DESCRIPTION OF A PREFERRED EMBODIMENT

Figure 1:
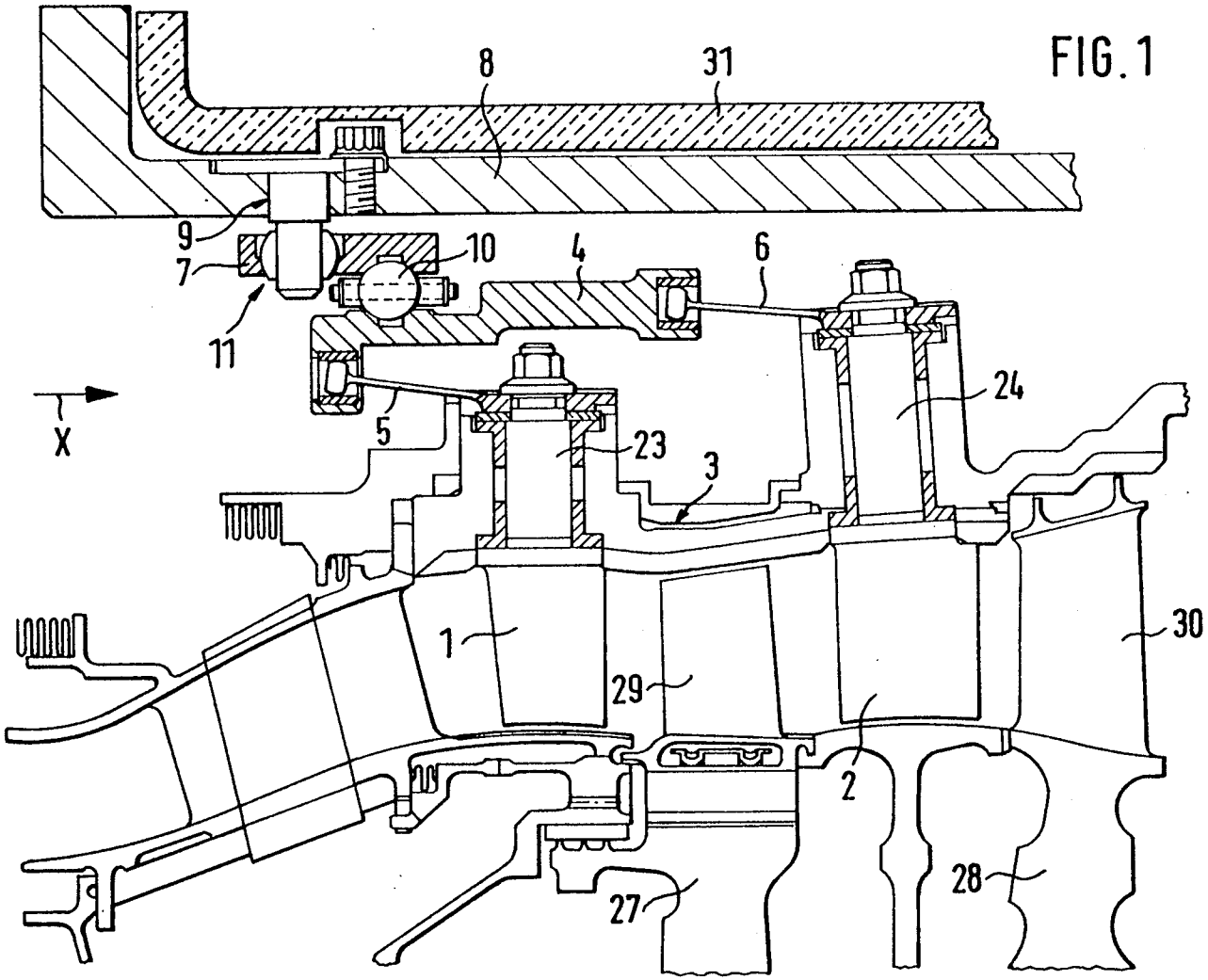
FIG. 1 is a longitudinal sectional view of a portion of a two stage turbine showing one embodiment of the apparatus of the invention.

Referring to FIG. 1, therein is shown apparatus for the support and adjustment of stator blades 1 and 2 of the first and second stages of a gas turbine. The turbine has a turbine housing 3 and radially outwards of housing 3 is an adjusting ring 4 coupled with circumferential rows of stator blades 1, 2 through lever means constituted by respective adjusting levers 5, 6. The adjusting ring 4 is rotatably supported in the circumferential direction on a support ring 7, which is, in turn, supported at a plurality of locations by an outer housing 8 which is radially outwards of inner turbine housing 3. The turbine housing 3 is relatively hot during operation of the gas turbine while the outer housing 8 is relatively cool. The support ring 7 is elastically deformable in the radial direction and its deformability is a function of the radial thickness of ring 7 which characterizes the radial rigidity of the ring 7. The support ring 7 is suspended on cylindrical pins 9 fixed in outer housing 8 of the turbine. The adjusting ring 4 is supported by ring 7 by a bearing including balls 10 which are engaged with pre-stress between rings 4 and 7 in the manner of a ball bearing wherein the rings 4 and 7 serve as inner and outer races. The ring 7 has a rectangular cross-section and its radial elasticity enables the pre-stress of the bearing to be developed.

Figure 3:
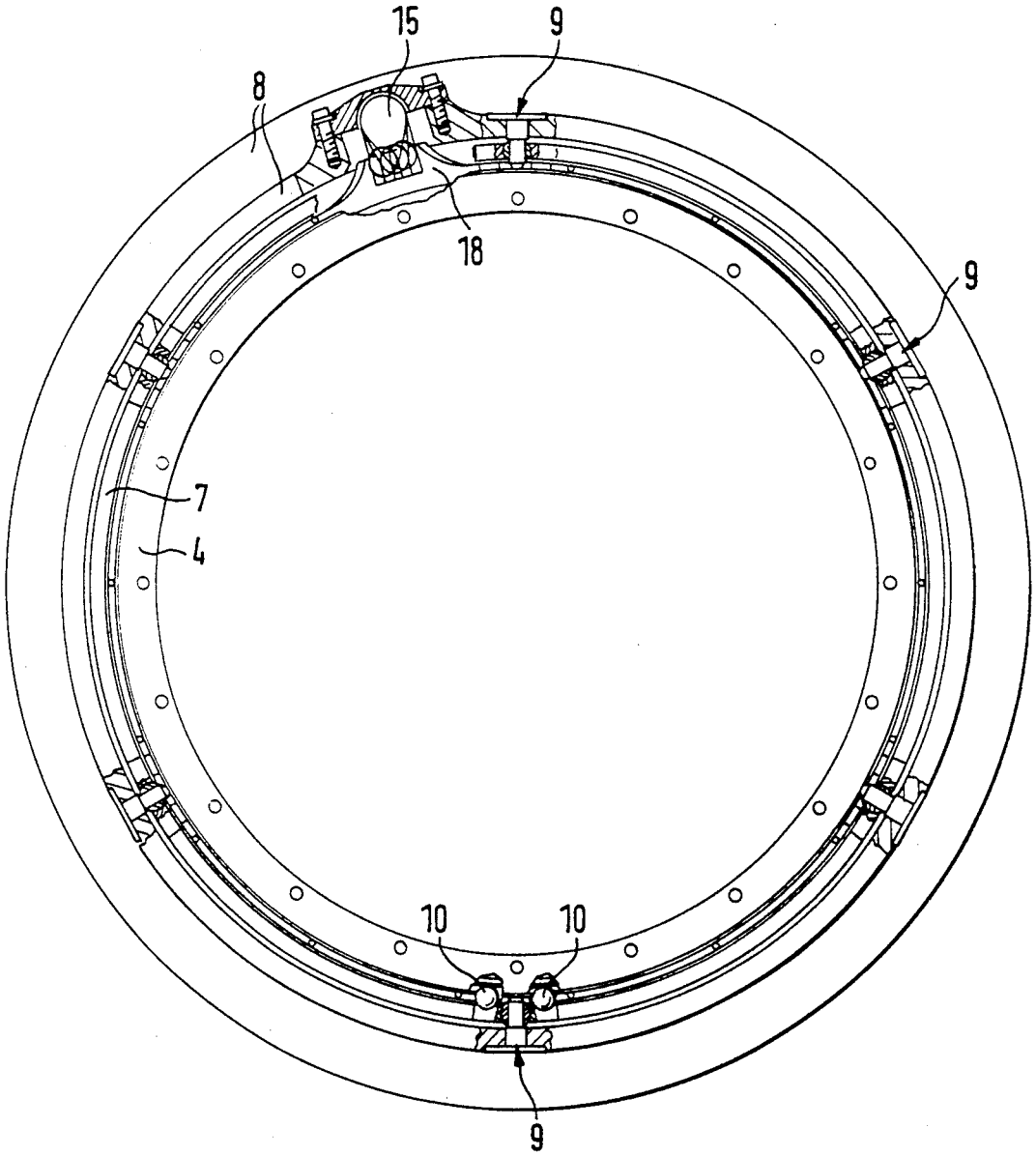
FIG. 3 is a simplified transverse view of the turbine, as seen in the direction of arrow X in FIG. 1, partly broken away and in section.
Figure 4:
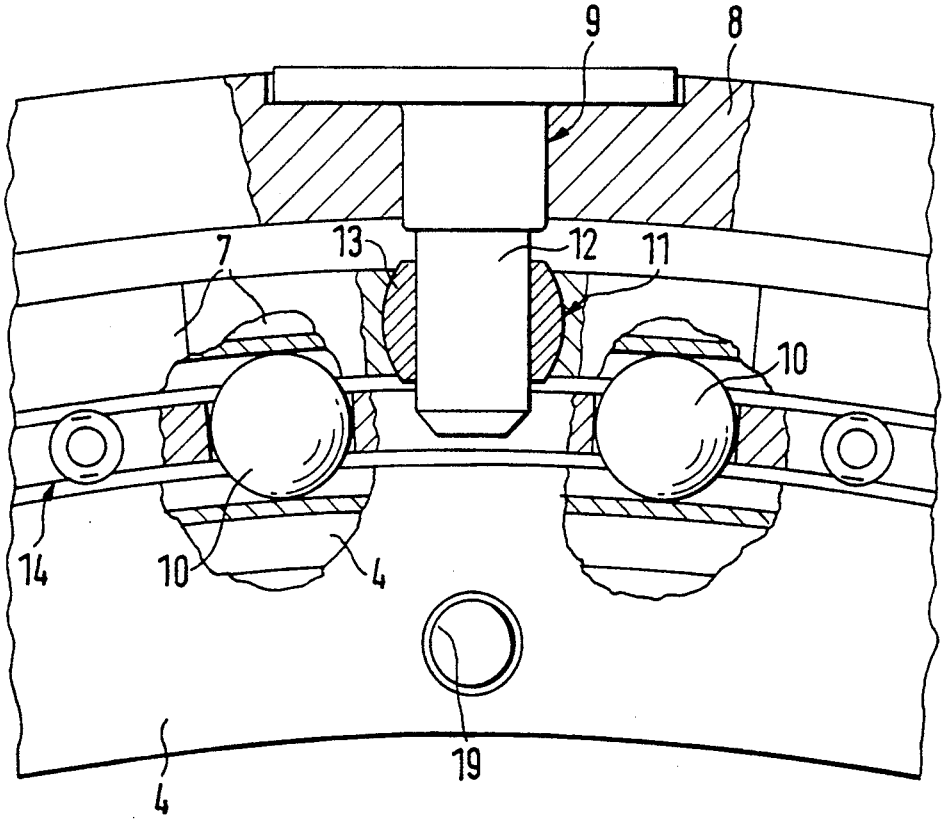
FIG. 4 is an enlarged view, partly broken away and in section, of a detail of the support means of the apparatus of the invention.

As evident in FIGS. 1 and 4, support ring 7 is suspended so as to be radially movable at bearings 11 supported on pins 9. The pins 9, which are fixed in outer housing 8 and project radially inwards, are uniformly distributed over the periphery of the housing as seen in FIG. 3. The bearings 11 are formed as bushings 13 with spherical or convex curved, outer surfaces which are axially movable in a radial direction along cylindrical segments 12 of pins 9 (FIG. 4). The outer surfaces of the bushings 13 engage with play in correspondingly curved recesses in support ring 7. The bushings 13 provide the necessary movement of support ring 7 around the pins 9 in all directions with the assurance of a simultaneous radial sliding fit on pins 9 in their respective axial directions.

The balls 10 of the bearing between rings 4 and 7 are arranged in the vicinity of pins 9 as shown in FIG. 4. They may, however, also be arranged in the circumferential direction equally spaced between pins 9.

With particular reference to FIG. 4, the balls 10 are held in a bearing cage 14, preferably arranged in a rotatable manner in the circumferential direction between the rings 4 and 7. The circumferential movement of cage 14 can be limited by stops (not shown).

Advantageously, balls 10 are made of a ceramic material, which is resistant to high temperature and wear, is of light-weight and of low heat conductivity. A preferred ceramic material is hot-pressed silicon nitride (SSN). For relatively low turbine temperatures, the balls 10 can be made from steel as in conventional roller bearings.

Figure 2:
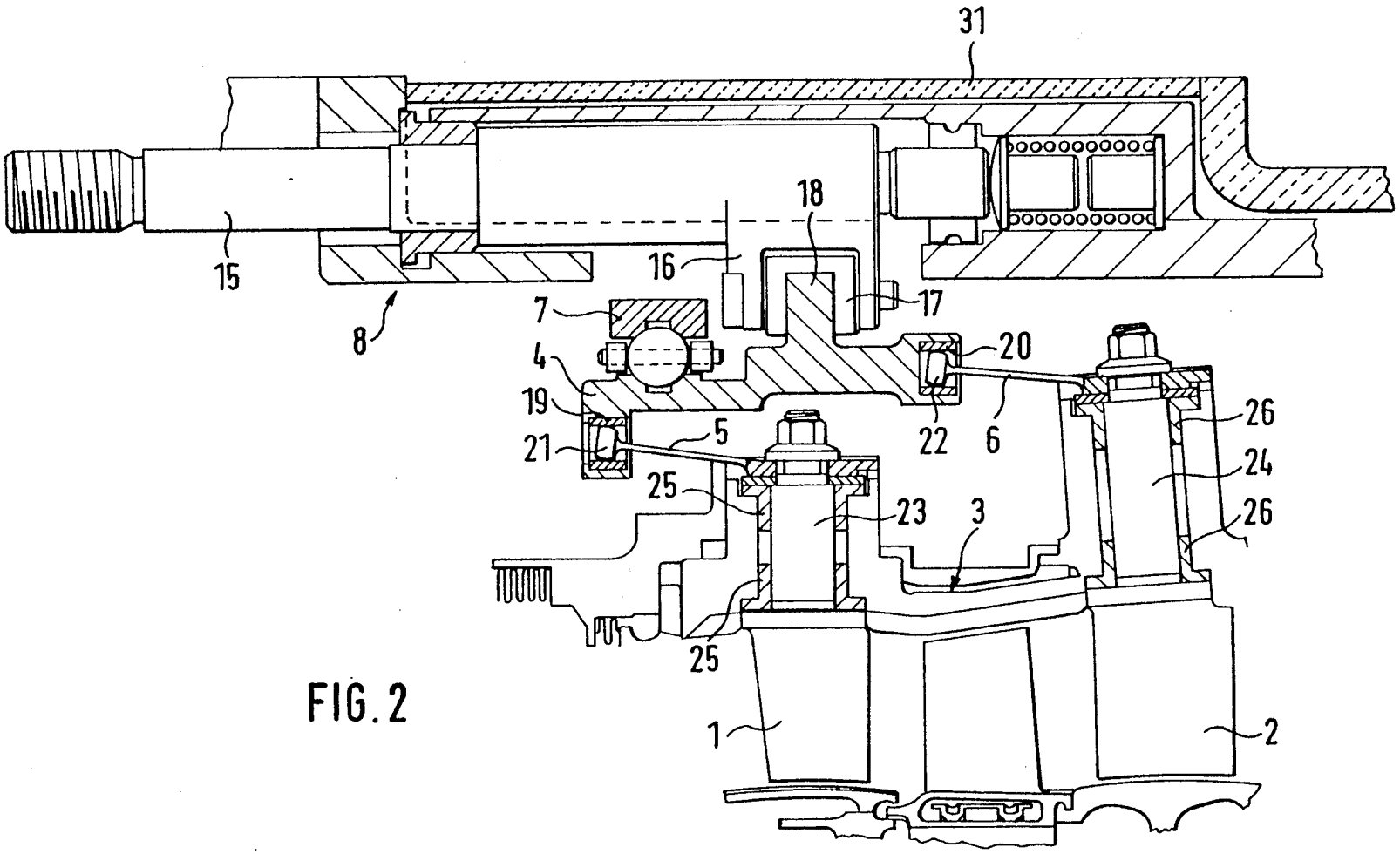
FIG. 2 shows the turbine according to FIG. 1 in a sectional view taken through the adjusting means of the apparatus.

As can be seen from FIG. 2, the adjusting means for the stator blades 1 and 2 comprises a motor driven shaft 15, which is rotatably supported in the longitudinal direction in outer housing 8. A roller 17 is mounted on a radial extension 16 of the shaft 15. The roller 17 engages in a slot provided in a radial projection 18 on adjusting ring 4. The extension 16 extends in a space between wall sections of housing 8 and undergoes angular turning upon rotation of shaft 15 to produce counter-rotation of adjusting ring 4 around the longitudinal axis of the turbine. Thus, a circumferential adjusting motion of adjusting ring 4 results from the adjusting force introduced via shaft 15. The adjustment levers 5 and 6 travel with the ring 4 and are supported by the ring 4 at fixed radial positions for universal pivotal movement to produce pivotal or turning movement of the stator blades in correspondence with the circumferential movement of the adjusting ring 4. The adjusting ring 4 has axial sockets 19, 20 uniformly spaced in the circumferential direction. In each socket is received one of the ends 21, 22 of adjustment levers 5, 6 in axially fixed relation but universally pivotable therein. The other of the ends of the adjustment levers 5, 6 are fixedly connected to the upper ends of respective shafts 23, 24 of stator blades 1, 2, the shafts 23, 24 being turnably supported in bushings 25, 26 of housing 3. The inner ends of the stator blades 1, 2 are spaced from the opposed structure of the turbine to form gaps or clearances therewith. Wheel disks 27, 28 of the rotor support rotor blades 29, 30 (FIG. 1).

The transfer of the rotating motion of adjusting shaft 15 to adjusting ring 4 may be obtained in other ways than by roller 17 and projection 18, for example, by a lever supported by shaft 15 and ring 4 or by gears on shaft 15 and ring 4.

As seen in FIGS. 1 and 2, the outer housing is provided with thermal insulation 31.

Although the invention has been described with reference to a single embodiment, it will become apparent to those skilled in the art that numerous modifications and variations can be made within the scope and spirtit of the invention as defined in the attached claims.

What is claimed is:

1. Apparatus for the precise adjustment of stator blades of a gas turbine, said apparatus comprising:

an inner turbine housing, an outer housing spaced radially outwards of said inner turbine housing, a plurality of circumferentially spaced pins secured to said outer housing and projecting radially inwards towards the inner turbine housing, a plurality of bushings, each slidably mounted on a respective said pin for travel along the axis of said pin, each said bushing having an outer curved surface, a support ring suspended on said bushings radially inwards of said outer housing, said support ring having openings with curved surfaces which are suspended on the curved surfaces of said bushings, an adjusting ring disposed between said support ring and said inner turbine housing, a plurality of circumferentially spaced rollers disposed between the support ring and the adjusting ring to rollably support the adjusting ring for circumferential movement, stator blade means pivotably supported in said inner housing, and lever means connecting said stator blade means to said adjusting ring to produce adjustable pivotal movement of said stator blade means upon circumferential movement of said adjusting ring.

2. Apparatus as claimed in claim 1, wherein said pins are circumferentially spaced at equal distances around said outer housing.

3. Apparatus as claimed in claim 2, wherein said support ring is shaped to be elastically deformable in the radial direction.

4. Apparatus as claimed in claim 2, wherein said rollers are spherical.

5. Apparatus as claimed in claim 4, comprising a cage supporting said rollers.

6. Apparatus as claimed in claim 5, wherein said cage is freely disposed between said adjusting ring and said support ring.

7. Apparatus as claimed in claim 4, wherein said spherical rollers are maintained between the adjusting ring and the support ring under stress.

8. Apparatus as claimed in claim 4, wherein said spherical rollers are made of a ceramic material which has low heat conductivity.

9. Apparatus as claimed in claim 8, wherein said ceramic material is hot pressed silicon nitride.

10. Apparatus as claimed in claim 2, wherein said curved surfaces of said bushings are spherical.

11. Apparatus as claimed in claim 2, wherein each said pin is disposed between two respective rollers.

12. Apparatus as claimed in claim 1, comprising thermal insulation means on said outer housing.

13. Apparatus as claimed in claim 1, comprising means for circumferentially displacing the adjusting ring to pivotably adjust the stator blade means.

14. Apparatus as claimed in claim 13, wherein said means for circumferentially displacing the adjusting ring comprises a rotatable input shaft and means coupling said input shaft with said adjusting ring for producing rotation of said adjusting ring in correspondence with rotation of said input shaft.

15. Apparatus as claimed in claim 1, wherein said stator blade means comprises a row of circumferentially spaced stator blades suspended in said inner housing, each stator blade including a shaft pivotal in said inner housing around an axis of the shaft, said lever means being coupled to the shafts of the stator blades.

16. Apparatus as claimed in claim 15, wherein said lever means comprises a pivotal rod for each stator blade, each pivotal rod having one end supported for universal pivotal movement in a fixed radial position in said adjusting ring and an opposite end fixedly connected to the shaft of the associated stator blade.

17. Apparatus as claimed in claim 16, wherein said stator blade means further comprises a second row of said stator blades connected by respective pivotal rods to said adjusting ring.

18. Apparatus as claimed in claim 1, wherein said support ring includes a portion having a rectangular cross-section.

19. Apparatus for the precise adjustment of pivotal stator blades of a gas turbine having an inner turbine housing surrounded by an outer housing, said apparatus comprising:

a support ring disposed between the inner turbine housing and the outer housing, means supporting said support ring from the outer housing at a plurality of circumferentially spaced locations with capability at each said location of radial displacement and universal pivotal movement relative to said outer housing, an adjusting ring, roller bearing means supporting said adjusting ring on said support ring for relative circumferential rotation of said adjusting ring on said support ring, means for producing circumferential movement of said adjusting ring, and lever means connecting said adjusting ring to stator blades of said turbine to pivot said stator blades upon circumferential movement of said adjusting ring.

20. Apparatus as claimed in claim 19 wherein said roller bearing means comprises a plurality of balls rollably supported between said support ring and said adjusting ring, said plurality of balls being arranged between said rings in circumferentially spaced relation and being engaged between said rings with pre-stress.

* * * * *